United States Patent [19]

Downey

[11] Patent Number: 4,877,042

[45] Date of Patent: Oct. 31, 1989

[54] DYNAMIC HAIR GROOMING APPLIANCE

[76] Inventor: John H. Downey, 114 Sandy Heaven Dr., Scarborough, Ontario, Canada, M1W 3M9

[21] Appl. No.: 38,179

[22] Filed: Apr. 14, 1987

Related U.S. Application Data

[63] Continuation-in-part of Ser. No. 533,450, Sep. 19, 1983, abandoned.

[51] Int. Cl.[4] ..... A45D 20/08

[52] U.S. Cl. ..... 132/212; 132/271; 34/50; 34/96; 34/46; 219/222

[58] Field of Search ..... 132/212, 148, 118, 227, 132/229, 271, 269, 333; 34/50, 55, 96, 48, 46, 97; 116/67 R, 102; 219/222, 241, 248

[56] References Cited

U.S. PATENT DOCUMENTS

| | | | |
|---|---|---|---|
| 3,082,540 | 3/1963 | Hiltenbrand | 34/50 |
| 3,173,428 | 3/1965 | Postel | 132/9 |
| 3,418,963 | 12/1968 | Copeland et al. | 132/148 |
| 4,167,820 | 9/1979 | de Groot | 34/48 |
| 4,259,566 | 3/1981 | Kobayashi | 132/212 |
| 4,260,875 | 4/1981 | Walter et al. | 34/48 |
| 4,744,154 | 5/1988 | Bollinger et al. | 34/55 |

FOREIGN PATENT DOCUMENTS

| | | | |
|---|---|---|---|
| 0642877 | 9/1950 | United Kingdom | 34/48 |
| 2048519 | 12/1980 | United Kingdom | 34/48 |
| 2093343 | 9/1982 | United Kingdom | 34/48 |

*Primary Examiner*—Gene Mancene
*Assistant Examiner*—Adriene J. Lepiane
*Attorney, Agent, or Firm*—Kenneth M. Garrett

[57] ABSTRACT

A hair grooming device such as a comb, a heated hair styler or a curler having a moisture sensing device and an indicator, thereby allowing the user to control the dryness of the hair while styling or curling the hair.

13 Claims, 5 Drawing Sheets

DYNAMIC HAIR GROOMING APPLIANCE

CROSS REFERENCE TO RELATED APPLICATION

This application is a continuation-in-part of U.S. patent application Ser. No. 533,450 filed Sept. 19, 1983 and abandoned Apr. 17, 1987.

BACKGROUND OF THE INVENTION

This invention is directed to hair grooming and styling appliances and, in particular, to appliances which are used in conjunction with heat.

Human hair is considered to be built up from very complex protein called Alpha-Keratin. The protein molecules are arranged in organized patterns and are held together with hydrogen or sulfur bonds. These bonds determine the degree of curliness of hair.

The hydrogen bonds are the bonds which are broken and reformed when washing and setting hair. Breaking these bonds is accomplished by warm water, steam or heat, thus it is common for persons to wash their hair prior to reshaping a hairstyle. Moist hair, due to the breaking of these bonds, is very elastic and can be stretched and formed by various means. When dry, the hydrogen bonds reform and the hair is said to have taken a set. Dry hair does not stretch so rough handling such as rolling and vigorous combing should be avoided as damaged due to breakage is possible. Overly dried hair will become brittle and may suffer from such unrepairable conditions as split ends.

Hair, being hydroscopic, will absorb moisture from the atmosphere. Hair drying and styling appliances such as hair dryers, curling irons and styling brushes, because they are heated, provide an artificially dry condition for the hair. Hair can withstand high temperatures, but excessive dryness is known to cause damage even at low temperatures. U.S. Pat. No. 3,082,540 issued to Hiltenbrand, describes a hair dryer that measures the humidity of the air after it has passed over the user's head. U.S. Pat. No. 4,260,875 issued to Walter et al., describes a hair dryer that measures the temperature of the air deflected off the user's head while drying and may serve as a measure of dryness of the hair. U.S. Pat. No. 4,259,566 issued to Kobayashi, describes a hair waving appliance that uses plural independently temperature controllable heaters and plural temperature sensing probes which may therefore serve to measure the wetness/dryness of the user's hair.

British Patent No. 801,286, issued to Josef Vatter, describes a hair roller which is pre-positioned in the hair to be dried while using a drying hood. One or more pairs of teeth on the roller form electrodes; the resistance between these electrodes is constantly monitored during the drying process, and compared to a present value. A signal is output when the sensed resistance is at least as high as this value, to indicate the drying process as being complete. It is apparent that the method will sense the moisture content of the hair at only one location, and that there may be considerable variation in the degree of dryness of the hair at other locations. The roller was provided with insulating stand-off rings to prevent the electrodes from contacting the scalp.

In a dynamic hair grooming appliance, by which is meant an appliance in the nature of a brush or comb or curling iron which will be normally moved through the hair for the grooming and styling thereof while the hair is being dried, the provision of sensing electrodes will permit the dryness of the hair to be determined at any location. It is apparent that the provision of stand-off insulating rings will hinder the grooming of the hair, and would therefore be impractical.

A further problem exists in providing a dynamic hair grooming appliance for determining the dryness of the hair. It will be appreciated that an appliance of this nature will be frequently moved to a position out of contact with the hair, in which position of the electrodes will sense a dry hair condition. The generation of a signal responsive thereto would be both irritating and confusing, particularly where the signal is an audio signal.

SUMMARY OF THE INVENTION

With a view to overcoming certain of the disadvantages outlined above, the invention provides a dynamic hair grooming appliance for use in conjunction with heating means, which heat can be applied to the hair from the appliance itself or from an external source, comprising grooming elements for contacting a localized portion of the hair for effecting the grooming thereof, means for sensing the moisture of the hair contacted in that locality, and signal means responsive to the degree of dryness of the hair contacted.

In accordance with one aspect of the invention, a dynamic hair grooming appliance comprises an axially elongated body portion from which hair engaging means is supported, and handle means therefor to permit the hair engaging means to be moved into selective contact with the hair of a person during the grooming thereof. Interspersed with the hair engaging means are electrodes; circuit means contained in the handle connects to the electrodes for measuring an elecrical value at the electrodes responsive to the moisture content of the hair contacted. Suitably this value is the ohmic resistance of the hair, which may typically change by a factor of about 100 to 200 times between a towelled dry and a fully dry condition. The circuit means includes signal means for giving an indication of whether the hair is wet or dry, and means responsive to the attainment of a predetermined value at the electrodes for changing the state of operation of the signal means.

In accordance with a preferred embodiment, the hair engaging means comprises a plurality of non-conducting teeth which project radially from the body portion, and the electrodes are mounted therefrom remote from the distal ends thereof. Preferably, the circuit means includes a delay means for delaying the change of state of operation of the signal means upon the attainment at the electrodes of the predetermined value. Thus, as the appliance is removed from the hair following its grooming in one locality, and prior to the hair being re-engaged, the resistance at the electrodes (assuming this to be the parameter measured) will be at least as great as that attained in dry hair, and without the delay the "dry condition" signal would be triggered. The delay period is not critical, and a period between about 1 and 3 seconds will be generally found to be suitable.

Desirably, the circuit means will include means for re-setting the signal means and the delay means automatically when the value at the electrodes changes from an attained value to a non-attained value.

By switching a resistance into serial circuit with the electrodes, the predetermined value of the resistance at the electrodes at which the signal will be triggered will be lowered, which is to say the hair will be more moist than when the resistance is short-circuited, thereby indicating that the hair is dried to a condition suitable for it to be styled.

IN THE DRAWINGS

DESCRIPTION OF THE EMBODIMENTS

Before describing the various appliances shown in the illustrations, it will be appreciated that the invention is applicable to a variety of different hair grooming devices, which may or may not incorporate means for heating the hair.

Typically, when grooming the hair, a conventional hair dryer or blower may beused which will apply warm air to the hair and thus dry it. Again, typically the user will also be grooming or styling the hair with a comb or brush. The comb or brush will constantly be applied to the hair, while the hair is subjected to the action of the warm air, with a view to grooming the hair or achieving a particular styling.

In some other appliances, heat may be applied to the hair for the purposes of rolling or curling the hair. These appliances may apply direct heat to the hair, by contact, with or without heating the hair by means of heated air.

The invention is considered to have a broad application to hair grooming devices, whether heated or unheated. In addition, the invention may be applicable to certain kinds of hair dryers or blowers, where such hair dryers or blowers incorporate some means for contacting the hair. Conceivably, other forms of hair grooming and styling devices may be developed in the future, or may exist, and the invention does not exclude in its application an adaptation to any other such forms of hair grooming devices, whether known or unknown and whether existing or developed in the future.

Figure 1:
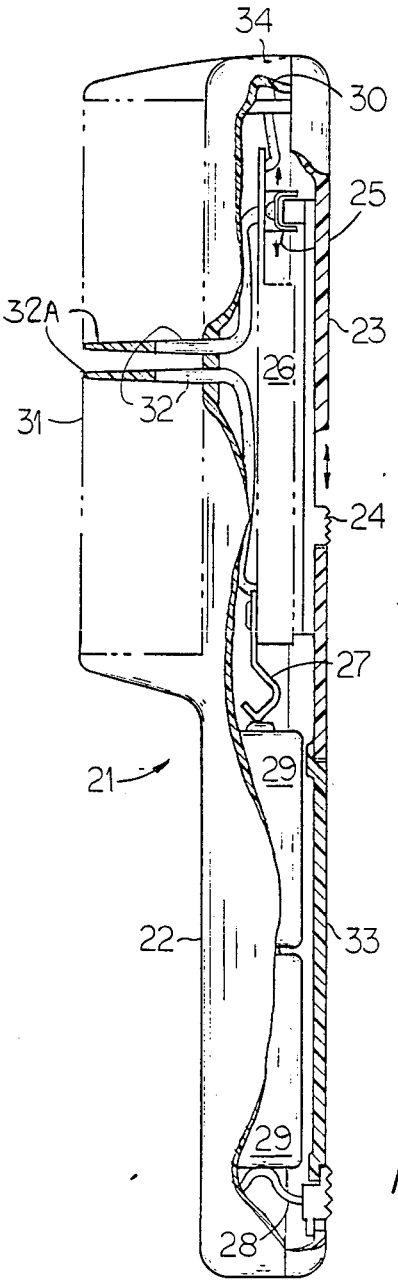
FIG. 1 is a partially broken-away, side view of a comb according to the invention.
Figure 2:
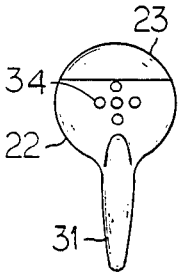
FIG. 2 is a top end view of the comb of FIG. 1.
Figure 3:
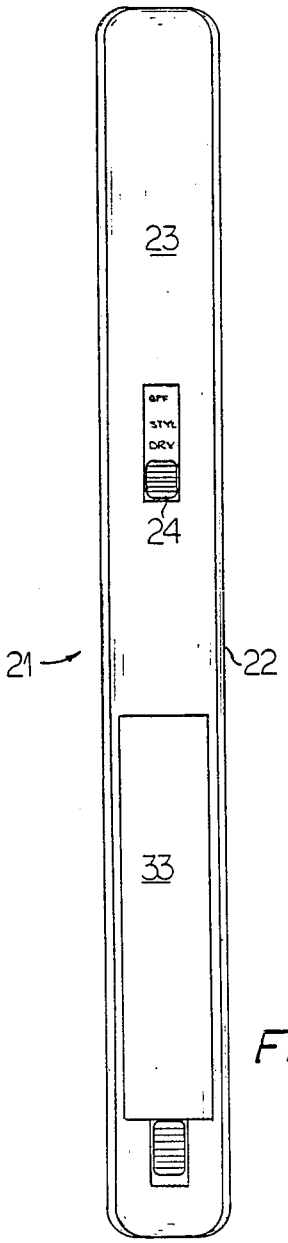
FIG. 3 is a side view of the comb of FIG. 1 rotated 90°.

Referring to FIGS. 1, 2 and 3, the comb 21 according to the invention comprises a rigid body of plastic, or other suitable material, having a handle portion 22 and a top body portion 23. A slidable arm 24 is movably joined to a selector switch 25 mounted on an electronic circuit board assembly 26. Battery terminals 27 and 28 made from stainless steel or other suitable material compressively touch the ends of batteries 29. A piezo noise-emitting chip 30 is incorporatively mounted in one end, connectively joined to the aforementioned circuit board assembly.

Teeth 31 protrude outwardly from body portion 23. Electrodes 32 are embedded in some such teeth so that contact is made with the hair as it passes through the teeth. The distal ends 32a of those teeth upon which electrodes 32 are mounted are formed from an electrically insulating substance. Suitably the electrodes 32 may be formed as metallized coatings upon the plastic teeth 31 of comb 21. While only two teeth are shown as having electrodes 32 mounted thereon, other pairs of teeth may be similarly provided with electrodes, the pair being connected in parallel relationship.

A removable hatch 33 is provided to allow changing of batteries.

It will be noted that the comb 21 of FIGS. 1, 2 and 3 does not incorporate any means for applying heat to the hair, either by direct contact or by hot air.

Typically, such a comb 21 will be used in conjunction with a hand-held hair dryer or blower. The comb 21 will be constantly drawn through the hair while it is being subjected to the action of warm air to dry it.

The comb 21 of FIGS. 1, 2 and 3 will thus provide an instantaneous direct read-out of the moisture content of the hair at any particular point on the scalp to which the comb 21 is applied. It can thus be used to direct the warm air from the hair dryer or blower to any particular areas of dampness which may exist even after other areas have already been dried to a sufficient degree of dryness.

Apertures 34 allow the sound made by the pieze chip 30 to reach the user's ear when the hair is suitably dry.

Figure 4:
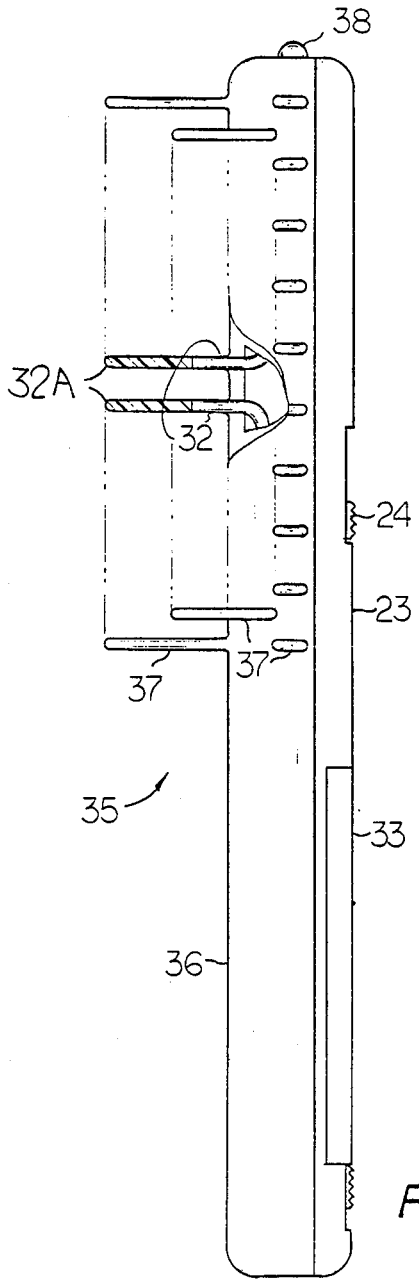
FIG. 4 is a partally broken-away side view of a brush accordng to the invention.
Figure 5:
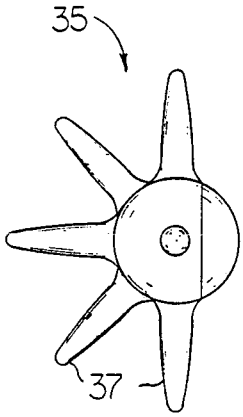
FIG. 5 is a top end view of the brush of FIG. 4.

Referring to FIGS. 4 and 5, the brush 35 according to the invention comprises a handle portion 36 of plastic or other suitable material, a body portion 23, hatch 33 identical to that of the comb 21 of FIGS. 1, 2 and 3, and a bottom or main portion 36 similar to the comb 21. In this case, however, the teeth 37 protrude radially outward in several rows. Electronic components and hardware are similar to aforementioned comb except that the piezo noise emitting chip 30 is omitted and replaced by a light emitting diode 38 to alert the user of dryness.

Both the comb 21 and the brush 35 of this invention are provided with a selecting switch 25 and arm 24 for varying the amount of moisture sensed, the function of which will be described later in detail. In one position the user can determine that the hair is still sufficiently moist that further styling, such as using a heated styling brush or curling iron, is unlikely to cause damage due to dryness. Another position can indicate that the hair is completely dry. Both settings are used as these devices would normally be used in conjunction with a hair dryer.

Figure 6:
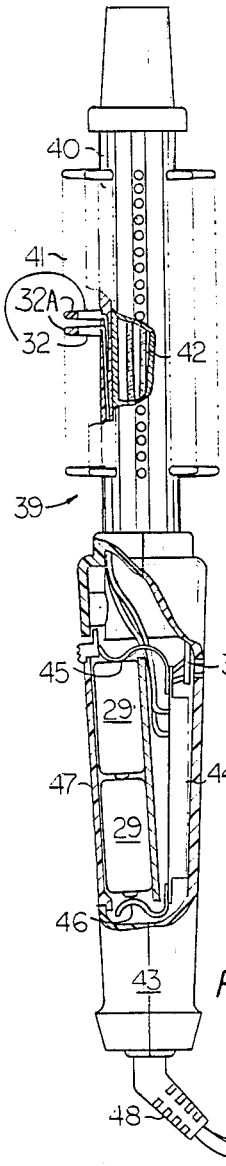
FIG. 6 is a partially broken-away side view of a heated styling brush according to the invention.
Figure 7:
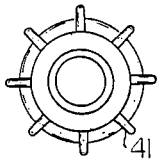
FIG. 7 is an end view of the heated styling brush.

Referring to FIGS. 6 and 7, the heated styling brush 39 of this invention comprises a barrel 40 made from aluminum that has a plurality of teeth 41 made from rigid plastic, or other suitable material, protruding therefrom. A heating element 42 is located within the barrel 40 and is heated by power supplied from the mains. A handle 43 made from rigid plastic encloses an electronic circuit board assembly 44. Battery terminals 45 and 46 made from stainless steel or other suitable material compressively touch the ends of batteries 29. A piezo noise-emitting chip 30 is mounted in handle 43. A removable hatch 47 is provided in the bottom of the handle to allow changing of the batteries. Power for the heater is provided through the cord set 48. Electrodes 32 are embedded in two teeth at the proximal ends and connectively joined to circuit board assembly 44.

Figure 8:
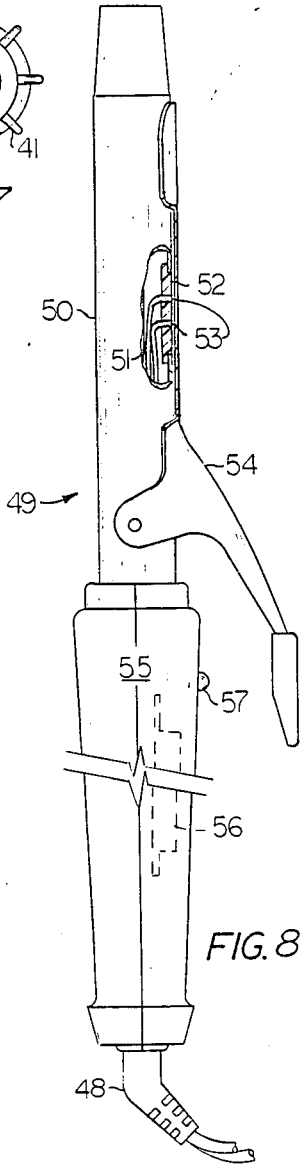
FIG. 8 is a partially broken-away side view of a heated curling iron according to the invention.
Figure 10:
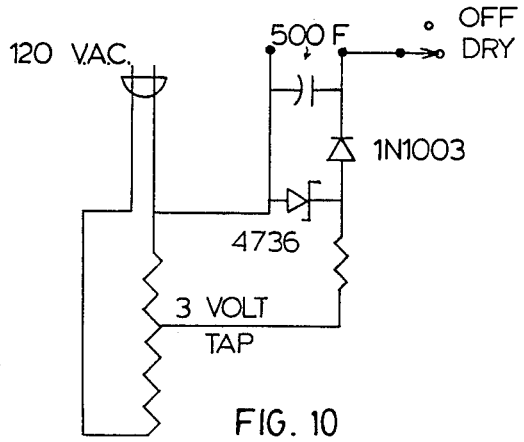
FIG. 10 is the same electronic circuit using a tap off the heating element as a power source.

Referring to FIG. 8, the heated curling iron 49 according to the invention comprises a metal barrel 50 that encloses a heating element 51 having an insulated area 52 made from heat resistant insulating material. Two electrodes 53 are embodied such that they contact the user's hair under the clamp 54. A handle 55 made from rigid plastic or other suitable material encloses an electronic circuit board assembly 56 connectively joined to the electrodes 53. A light emitting diode 57 is provided to indicate dryness. A hatch as described in FIG. 7 is not required as the power is drawn from tapping the heating element as shown in FIG. 10, and the batteries are not required.

Figure 9:
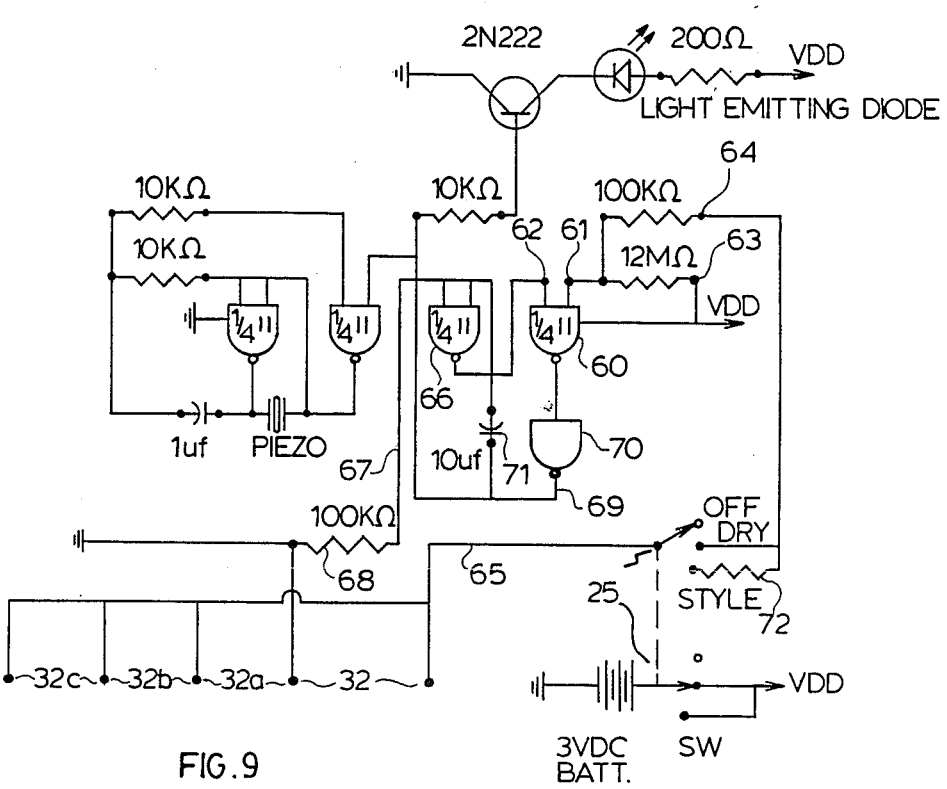
FIG. 9 is a schematic view of a suitable electronic circuit using a battery as a power source.

With reference to FIG. 9, an electronic circuit as used in the foregoing apparatus is illustrated schematically therein. The circuit includes a NAND device 60 having inputs 61 and 62. Input 61 is connected to supply voltage VDD through a high resistance 63 to provide a threshold voltage at input 61 sufficient to trigger gate 60. Input 60 also connects via a 100K OHM resistance 64 to switch 25. Assuming this to be set to its mid-position marked "DRY" this will then interconnect input 61 via line 65 to one of electrodes 32, and through hair locating between the electrodes, to the appliance ground. When the resistance of the hair is relatively low, the input voltage at 61 will be reduced to below the firing voltage of gate 60. As the resistance of the hair increases, so the firing voltage will be reached. The gronded electrode connects to both inputs of a NAND device 66 through line 67 and resistor 68. The output from device 66 will accordingly be always high, and this connects to input 62 of device 60. Accordingly, device 60 will output a low signal whenever the threshold voltage at input 61 is reached or exceeded.

The output from device 60 is inverted on line 69 by inverter inventor 70. A timing capacitor 71 connects line 69 through resistor 68 to ground. The timing constant for the values illustrated in FIG. 9 is 1 second. Thus, providing the input at 61 is high for at least one second, an output on line 69 will change the state of operation of the LED and piezo signalling devices illustrated. As soon as the voltage at input 61 is reduced to below the threshold voltage, as will occur when damp hair contacts electrodes 32, the output on line 69 will be driven to zero thereby automatically re-setting the signalling devices to their former state. Additionally, timing capacitor 71 will be discharged through line 67 and resistor 68, whereby the full delay period provided by the circuit will be re-established.

Assuming switch 25 to be set to its third position marked "STYLE", a resistance 72 is incorporated serially in line 65, thereby reducing the ohmic value required at electrodes 32 to drive device 60 to its conducting state; accordingly it will be seen that the hair will have a somewhat greater moisture content when the signal device or devices are triggered than when switch 25 is set to the DRY condition.

Typical values for the ohmic resistance across two electrodes set apart by a distance of about 5 mm, as may be found in the teeth of a grooming appliance, are as follows:

| OHMS $\times 10^6$ | |
|---|---|
| 0.4 to 2 | towel dry |
| 4 to 8 | style |
| 40 to 80+ | dry |

In order to reduce the sensed resistance, it is desirable to provide several pairs of electrodes connected in parallel, as suggested in FIG. 9 by the reference numerals 32, 32*a*, 32*b*, and 32*c*. Preferably four pairs of electrodes are provided, which pairs formed by five interdigitating teeth, so as to restrict the locality of the sensing area.

Neither the heated styling brush 39 nor the heated curling iron 49 of this invention require multiple dryness settings described in the comb 21 and brush 35 as it is not desirable to have moist hair after using this type of hair grooming appliance.

The usage of the devices according to the invention is self evident.

The comb of brush of FIGS. 1, 2, 3, 4 and 5 is intended to be used in conjunction with some form of hair drying device such as a hair dryer or blower. In this usage, the hair dryer or blower applies warm air to the hair while the comb or brush is simply passed through the hair. The comb or brush will give an indication of the degree of dryness of the hair independently of the operation of the hair dryer itself.

The devices, such as the styling brush or curling appliances will be used in the typical way in which such devices have been used in the past except that they will give an indication in some form or another, either by a light or a noise, of the degree of dryness of the hair. In either case, appropriate action can be taken. Where multiple settings are provided, then one setting will give an indication of the existence of certain residual moisture so that drying and styling can be continued. When a second setting is reached, it will indicate that drying must cease. As mentioned, the invention is applicable to a wide range of hair grooming or styling devices and is not confined merely to those shown herein. The devices shown herein are merely schematic illustrations, which are given by way of example only, for purposes of illustrating the invention and its application to various different uses.

The foregoing is a description of a preferred embodiment of the invention which is given here by way of example only. The invention is not to be taken as limited to any of the specific features as described, but comprehends all such variations thereof as come within the scope of the appended claims.

I claim:

1. A dynamic hair grooming appliance comprising:

an axially elongated body portion;

hair engaging means supported from said body portion;

handle means from which said body is supported for moving said hair engaging means into selective contact with the hair of a person to effect the grooming thereof;

electrode means for contacting the hair interspersed with said hair engaging means and positioned remote from the distal ends thereof so as not to contact the scalp of a person during said grooming, and circuit means located in said handle and electrically connected to said electrode means for measuring an electrical value at said electrode means related to the moisture content of hair contacted thereby, said circuit means further including signal means and means responsive to the attainment of a predetermined value at said electrode means for changing the state of operation of said signal means.

2. A dynamic grooming device as claimed in claim 1, wherein said hair engaging means comprises a plurality of teeth extending radially from said body, and wherein said electrode means is mounted on portions of at least two said teeth remote from the distal ends thereof.

3. A dynamic grooming device as claimed in claim 1 or 2, wherein said circuit means includes delay means for delaying the change of state of operation of said signal means for a small time period upon the attainment of said predetermined value so as to reduce the incidence of generating spurious signals from said signal means.

4. A dynamic grooming device as claimed in claim 3, wherein said circuit means includes re-set means automatically responsive to the reversion of said value at said electrode means less than said predetermined value for re-setting said signal means.

5. A dynamic grooming device as claimed in claim 3 wherein said circuit means includes switch means for varying said predetermined value.

6. A dynamic hair grooming appliance comprising:

an axially elongated body portion;

hair engaging means supported from said body portion;

handle means from which said body is supported for moving said hair engaging means into selective contact with the hair of a person to effect the grooming thereof;

electrode means for contacting the hair interspersed with said hair engaging means, and circuit means located in said handle and electrically connected to said electrode means for measuring an electrical value at said electrode means related to the moisture content of hair contacted thereby, said circuit means further including signal means and means responsive to the attainment of a predetermined value at said electrode means for changing the state of operation of said signal means, wherein said circuit menas includes delay means for delaying the change of state of operation of said signal means for a small time period upon the attainment of said predetermined value so as to reduce the incidence of generating spurious signals from said signal means.

7. A dynamic grooming device as claimed in claim 6, wherein said circuit means includes re-set means automatically responsive to the reversion of said value at said electrode means less than said predetermined value for re-setting said signal means.

8. A dynamic grooming device as claimed in claim 6, wherein said hair engaging means comprises a plurality of teeth extending radially from said body, and wherein said electrode means is mounted on portions of at least two said teeth remote from the distal ends thereof.

9. A dynamic grooming device as claimed in claim 6 or 8, wherein said circuit means includes switch means for varying said predetermined value.

10. A dynamic grooming device as claimed in claim 2 or 8, wherein the number of teeth on which said electrode means is mounted is five connected in parallel to provide four pairs of electrodes.

11. A dynamic grooming device as claimed in claim 1 or 6, wherein said electrical value measured at said electrode means is an ohmic resistance.

12. A dynamic grooming device as claimed in claim 1 or 6, wherein said hair engaging means comprises a plurality of axially aligned rows of teeth.

13. A dynamic grooming device as claimed in claim 1 or 6, further comprising heating means contained within said body for drying said hair during the grooming thereof.

* * * * *